US007239094B2

(12) United States Patent
Radzinski et al.

(10) Patent No.: US 7,239,094 B2
(45) Date of Patent: Jul. 3, 2007

(54) ELECTRONIC BALLAST WITH ADAPTIVE LAMP PREHEAT AND IGNITION

(75) Inventors: Christopher Radzinski, Huntsville, AL (US); John Jay Dernovsek, Madison, AL (US); Qinghong Yu, Salem, MA (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 11/004,646

(22) Filed: Dec. 3, 2004

(65) Prior Publication Data

US 2005/0168175 A1 Aug. 4, 2005

Related U.S. Application Data

(60) Provisional application No. 60/526,639, filed on Dec. 3, 2003.

(51) Int. Cl.
*H05B 37/02* (2006.01)

(52) U.S. Cl. ..... 315/307; 315/291; 315/224; 315/DIG. 5

(58) Field of Classification Search ..... 315/291, 315/224, 225, 307, 209 R, 105, 106, DIG. 2, 315/DIG. 5, DIG. 7
See application file for complete search history.

(56) References Cited

U.S. PATENT DOCUMENTS

| | | | | |
|---|---|---|---|---|
| 5,083,065 | A * | 1/1992 | Sakata et al. | 315/DIG. 7 |
| 5,436,529 | A | 7/1995 | Bobel | 315/106 |
| 5,444,336 | A * | 8/1995 | Ozawa et al. | 315/DIG. 5 |
| 5,493,180 | A | 2/1996 | Bezdon et al. | 315/106 |
| 5,500,576 | A | 3/1996 | Russell et al. | 315/307 |
| 5,636,111 | A | 6/1997 | Griffin et al. | 315/225 |
| 5,770,925 | A | 6/1998 | Konopka et al. | 315/225 |
| 5,945,788 | A | 8/1999 | Li et al. | 315/291 |
| 5,969,483 | A | 10/1999 | Li et al. | 315/224 |
| 5,982,106 | A | 11/1999 | Bobel | 315/209 R |
| 6,121,731 | A * | 9/2000 | Kanazawa et al. | 315/209 R |
| 6,127,786 | A | 10/2000 | Moisin | 315/291 |
| 6,169,369 | B1 | 1/2001 | Nerone et al. | 315/106 |
| 6,211,623 | B1 | 4/2001 | Wilhelm et al. | 315/224 |
| 6,259,215 | B1 * | 7/2001 | Roman | 315/307 |
| 6,316,887 | B1 | 11/2001 | Ribarich et al. | 315/307 |
| 6,424,101 | B1 * | 7/2002 | Sabate | 315/291 |
| 6,501,225 | B1 | 12/2002 | Konopka | 315/105 |
| 6,552,494 | B2 | 4/2003 | Randazzo et al. | 315/106 |
| 6,936,973 | B2 * | 8/2005 | Parra et al. | 315/224 |
| 2002/0105283 | A1 | 8/2002 | Murakami et al. | 315/224 |
| 2003/0025464 | A1 | 2/2003 | Konopka | 315/291 |

FOREIGN PATENT DOCUMENTS

| | | |
|---|---|---|
| EP | 0061730 | 6/1982 |
| EP | 0576991 | 5/1994 |
| JP | 2001-326089 | * 11/2001 |

* cited by examiner

*Primary Examiner*—David Vu
*Assistant Examiner*—Ephrem Alemu
(74) *Attorney, Agent, or Firm*—Waddev & Patterson; Mark J. Patterson

(57) ABSTRACT

An electronic ballast includes a microcontroller with software to provide an adaptive lamp preheat and ignition operation. The microcontroller commands a test frequency from the inverter and detects the frequency response of the resonant output circuit by measuring the voltage across the resonant capacitor. The measured voltages are compared to one or more reference voltages as the frequency is varied to select the optimal inverter frequency. An algorithm or look-up table is used to set the inverter frequencies for the lamp preheat and ignition phases.

9 Claims, 6 Drawing Sheets

Adaptive Programmed Start

ELECTRONIC BALLAST WITH ADAPTIVE LAMP PREHEAT AND IGNITION

CROSS-REFERENCES TO RELATED APPLICATIONS

This application is a Non-Provisional Utility application which claims benefit of co-pending U.S. Provisional Patent Application Ser. No. 60/526,639 filed Dec. 3, 2003, entitled "Adaptive Preheat and Strike for Microcontroller Based Ballast" which is hereby incorporated by reference.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to electronic ballasts used to operate gas discharge lamps. More particularly, this invention pertains to circuits and methods used to control the preheating and ignition ("striking") of a gas discharge lamp by an electronic ballast having a resonant tank output.

Conventional electronic ballasts typically combine a power factor correction (PFC) stage with a high frequency resonant inverter to preheat, strike and drive a fluorescent lamp at different frequencies. The parallel-loaded, series resonant inverter and LCC inverter (which has a smaller value of series-connected capacitors) are both widely used in electronic ballasts. FIG. 1 illustrates a simplified circuit for these inverter topologies driving a load of two series-connected lamps. Both circuit types have the same topology, but in the LCC version the blocking capacitor Cs is small enough that it contributes to the resonant properties instead of merely being a DC block. FIG. 1 also shows the filament preheat circuitry. The auxiliary windings L3, L4, and L5 are wound on the same core as inductor Lr to provide the preheat current to the lamp filaments. Capacitors C3, C4, and C5 present a lower impedance at the preheat frequency and a higher impedance at normal operating frequency to reduce filament loss after ignition of the lamp. Before lamp ignition, the resonant tank circuit comprising Lr and Cp dominates the behavior of the inverter, and a high voltage can be generated across Cp to strike the lamp. After lamp ignition, the impedance of the lamp is low such that Lr and Cs dominate the behavior of the circuit. The transfer functions of these circuits are well studied. Bode plots of the resonant tank circuit is plotted in FIG. 2, before and after the ignition of the lamp.

A conventional analog control circuit for an electronic ballast typically uses resistors to set three different inverter frequencies for preheating the filaments, striking the lamp, and operating the inverter at the normal running frequency. In such control circuits, the values of the resistors and capacitors can also be used to "program" the time duration of the preheat phase. These three inverter frequencies are plotted on FIG. 2 as points A, B, and C. Although there are limitations to programming these functions using different resistor and capacitor values, analog controllers are popular because of their low cost.

Other operational factors arise when the power flow of the inverter is considered. During normal ballast operation after ignition of the lamp, energy constantly circulates between Cp and Lr. As shown in FIG. 1, the current flowing in Lr ($I_L$) is the sum of the lamp current ($I_{Lamp}$) and the current flowing through capacitor Cp ($I_{Cp}$). Because the voltage across the fluorescent lamps is determined by the lamp specification, $I_{Cp}$ is a function of the value of Cp and the inverter frequency, which is generally between 40 kHz and 65 kHz. As an example, for an application having two T5 lamps connected in series, the AC voltage across Cp is approximately 250 V and the lamp current is 440 mA. The ratio of the currents $I_{Cp}$ to $I_{Lamp}$ is calculated over the range from 40 kHz and 65 kHz, with the value of Cp ranging from 1 nF to 4 nF. FIG. 3 shows that the ratio of the amplitudes of $I_{Cp}$ to $I_{Lamp}$ ranges from 0.4 to more than 0.9, with the $C_p$ value between 3 nF and 4 nF. FIG. 3 also shows that $I_{Cp}$ decreases significantly with smaller values of $C_p$ and at lower frequencies. For a typical LCC tank, the currents $I_L$, $I_{Cp}$ and $I_{Lamp}$ are illustrated as vectors in FIG. 4, where $V_{ac}$ is the vector of the fundamental frequency AC voltage of the output of the inverter and a is the angle between $I_{Lamp}$ and $I_{Cp}$. The conduction loss of the current $I_L$ can be calculated with a geometric approach:

$$R \cdot I_L^2 = R \cdot I_{Lamp}^2 + R \cdot I_{Cp}^2 + 2R \cdot |I_{Lamp} \cdot I_{Cp}| \cos(\alpha)$$

where R can be the resistance of either the inductor or the switches.

In a parallel loaded, series resonant inverter, because of the larger value of $C_s$, $\alpha$ is close to 90 degrees and the factor $2R \cdot |I_{Lamp} I_{Cp}| \cos(\alpha)$ is very small. However, the $R \cdot I_{Cp}^2$ factor can still be high with a large value for $C_p$. For the LCC ballast circuit, $I_{Cp}$ increases $I_L$ more significantly and with a being smaller, the conduction loss is even higher. In FIG. 4, the vectors of the voltages across the lamps, and across Cs, and Cp, are also shown at a different scale. Based on the phase relationship between the voltage and current of a capacitor, $$\tan(\alpha) = 2\tau f Cs \cdot R_{lamp}$$

where f is the normal running frequency and $R_{lamp}$ is the resistance of the lamp, both the amplitude of $I_{Cp}$ and $\alpha$ determine conduction loss. On the other hand, because the flux density of the core of the inductor is proportional to $I_L$, a higher $I_L$ increases core losses in addition to the conduction loss.

In the lamp ignition phase, energy flows only into the resonant tank and builds up as current in Lr and voltage across Cp until the lamp starts to ignite. Thus, a high value Cp requires Lr to store more energy, which means either more losses or a larger core size. The peak voltage required to start the lamp is typically high and the components are subjected to the highest stress in this situation. With the load of the lamp removed from the circuit in FIG. 1, the inverter has only an LC tank as the load. Thus, $$\frac{1}{2} C_p V_{AC_peak}^2 = \frac{1}{2} L_r I_{peak}^2$$

where the $V_{AC_peak}$ and $I_{peak}$ are the peak values of the AC voltage across Cp and the current in Lr.

With $V_{AC_peak}$ set by the lamp manufacturer to strike the lamp, and Lr set to provide a specified lamp current at the steady state frequency, $I_{peak}$ becomes a function of Cp:

$$I_{peak} = \sqrt{\frac{C_p}{L_r}}\, V_{AC_peak}$$

Obviously, $I_{peak}$ decreases with a reduced value of Cp. To avoid hard switching, Lr must not saturate at $I_{peak}$. This requires a larger air gap with higher fringing losses, more winding turns with more conduction losses, and, in some cases, a bigger core with more core losses and higher cost.

Using a low value of $C_p$ with traditional analog control circuits is not practical because of the stray capacitance associated with the connection between the ballast and the fixture and with the fixture itself. In the field, it is very common for the ballast output cable to connect to the lamps in the fixture after passing though 18 feet or more of conduit having a metal wrap. The stray capacitance from the ballast output cable to the conduit and to ground is effectively in parallel with Cp in the circuit, and is represented in FIG. 1 as $C_{stray}$. An example is shown in FIG. 5 for a LCC resonant tank with Lr=1.95 mH and Cs=15 nF. The value of Cp is selected to be low, 1.8 nF. Assuming Cstray varies from 0 to 200 pF, the frequency response of the striking voltage of the resonant tank before the ignition of lamp is illustrated in FIG. 5. With an increase in the stray capacitance or in the length of the external ballast output cable, the entire frequency response curve shifts to a lower frequency and the resonant frequency shifts from 85 kHz to 80.6 kHz. FIG. 6 shows the variation in measured peak lamp striking voltage as a function of the length of the conduit connected to the resonant tank, at a constant inverter frequency of 93 kHz. This measurement confirms that stray capacitance can result in insufficient striking voltage. Conventionally, analog ballasts for driving T8 and compact lamps are arranged to achieve ignition in the presence of a conduit by sweeping the ignition frequency. The frequency is steadily reduced, and eventually hits the resonant frequency and ignites the lamp. For linear lamp fixtures with the common connected filaments in parallel (the U.S. convention) the constraint on the use of this technique comes from the Underwriters Laboratory "through lamp leakage" requirement. This stipulates in effect a maximum duration for which a given ground fault current can persist. For T8 lamps this is on the order of 20 milliseconds, and it is just possible to execute a frequency sweep in this time. However, with T5HO lamps which run at much higher currents (440 mA instead of 180 ma) the permissible pulse duration is only about 1 millisecond and with current technology it is not possible to perform a frequency sweep during this time interval. Hence it becomes necessary to select the correct frequency for ignition for each length of conduit that is connected.

For most common filament heating circuitry as shown in FIG. 1, auxiliary windings are added to the same core of Lr, as L3 to L5 shown in FIG. 1, to provide the voltages to preheat the filaments. With external stray capacitance added to the tank, the frequency response curve shifts to the left, and the filament preheat voltage decreases. As the result, the filament preheat is not sufficient and the life span of the lamp is reduced. The conventional analog control chip used in electronic ballasts has very little flexibility and the only way to reduce the effects of stray capacitance is to increase the value of Cp.

Several approaches have been used in the prior art to address the problems of maintaining optimum lamp preheat and ignition conditions in microcontroller-based electronic ballasts. In one approach, a large resonant capacitor can be selected such that the affects of the stray capacitance associated with the output cable is small compared to the total resonant capacitance. In another approach, for instant start ballasts, during the start, the resonant inductor saturates. After saturation, the inductance value is very small. The resonant peak thus moves to a very high frequency, much higher than the striking frequency. Because the striking frequency is so far away from the resonant peak, the voltage on the resonant capacitor is no longer sensitive to the variation of the parameters of the resonant capacitor. This allows the ballast to start the lamp with different output cable lengths with essentially the same voltage. There are several obvious disadvantages to this solution. When such a ballast is in the lamp striking phase, it is operating deeply in a capacitive mode with high current and high voltage stresses on the inverter transistors. There can be more than 100 hard switching cycles when no lamp is connected, which is hazardous to the ballast.

In cases where the resonant inductor does not saturate, as seen in most program start ballasts, with a higher value of resonant capacitance and a lower lamp ignition voltage to start the lamp, it is not difficult to start the lamp. However, a higher resonant capacitance establishes a preheat frequency that cannot be much higher than the normal running frequency. As a result, the filament capacitor does not provide much attenuation to the filament current at normal operating frequency when under conditions when the preheat to the filaments is sufficient. The losses on the filaments are relatively high.

In either program start or instant start ballasts, a high value of the resonant capacitor results in high circulation current at steady state, which means higher conduction losses in the transistors and inductor.

What is needed, then, is an electronic ballast having a control circuit that can sense the operating environment of the ballast and adapt the ignition frequency of the inverter to provide optimum preheating and striking of the lamp connected to the ballast.

BRIEF SUMMARY OF THE INVENTION

To improve the ability of electronic ballasts to provide optimum inverter frequencies during lamp preheat and ignition, one object of the present invention is to detect the unloaded frequency response of the inverter resonant tank during or before the preheat and/or strike of the lamp. This information is used by a microcontroller operating the ballast to adapt the inverter frequency during lamp preheat and ignition phases. The microcontroller can select the optimum frequency to strike the lamp with minimum stress on the components, and make it possible to use minimum value of parallel resonant capacitor.

Thus, in one embodiment of the invention, an electronic ballast for operating a gas discharge lamp includes an inverter circuit that is operable at one or more inverter frequencies. The inverter circuit is electrically coupled to a resonant output circuit. An inverter control circuit is operatively connected to the inverter circuit with the control circuit including an inverter frequency program operative to vary the inverter frequency. The inverter control circuit further includes a frequency response program that measures the frequency response of the resonant output circuit. The inverter frequency program is responsive to the frequency response program so as to vary the inverter frequency in accordance with measurement of the frequency response of the resonant circuit. Preferably, the control circuit uses the measurements of the frequency response of the resonant tank to adjust the inverter frequency to provide optimum preheating and ignition of the lamp.

During normal operation, the efficiency of the ballast is improved due to lower circulation current and smaller size of the resonant inductor. This allows the ballast to consistently preheat and strike the lamp with optimum frequency, taking into account variations in the values of the resonant inductor, resonant capacitor, and, in particular, the stray reactance introduced by a long external conduit connecting the ballast to the lamp. Accordingly, the resonant capacitor and magnetic core of the resonant inductor can be designed to be smaller. A smaller resonant capacitor results in a lower circulation current and lower losses in the inverter transistors inductors. This, in turn, allows the preheat frequency to be higher, so that the filament capacitor can be smaller. Consequently, the steady state losses on the lamp filament are reduced, and the pin current limitation of the lamp is easier to satisfy. The ballast is less expensive, runs cooler, performs better, and is easier to design, for instant start, program start, or dimming ballasts.

DETAILED DESCRIPTION OF THE INVENTION

The microcontroller has been used in the prior art to control certain functions in an electronic ballast, such as lamp detection, re-lamping, and multiple striking. However, prior art use of microcontrollers has not resulted in improvement of inverter performance during the lamp preheat and ignition phases.

Figure 1:
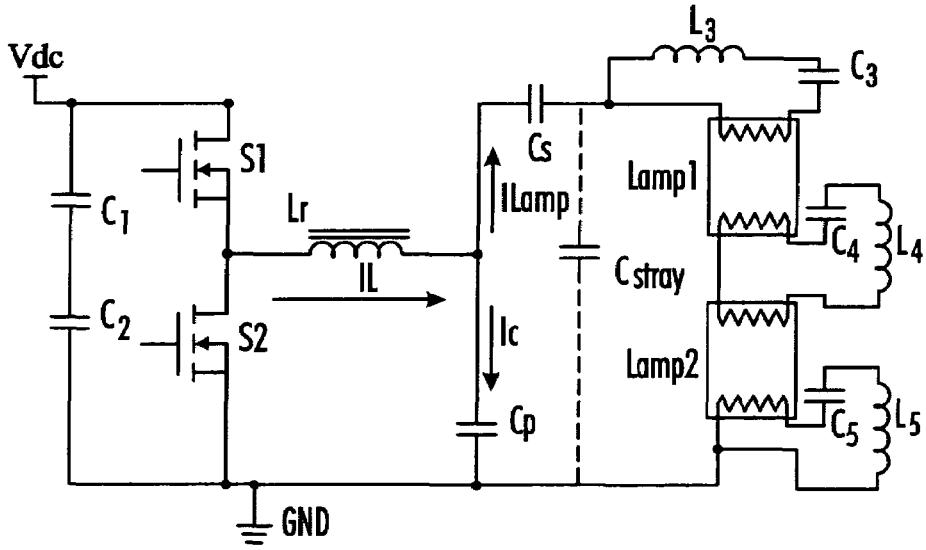
FIG. 1 is a schematic diagram of the inverter stage of a conventional electronic ballast having a parallel loaded, series resonant (or LCC) topology, driving a pair of series connected lamps.
Figure 2:
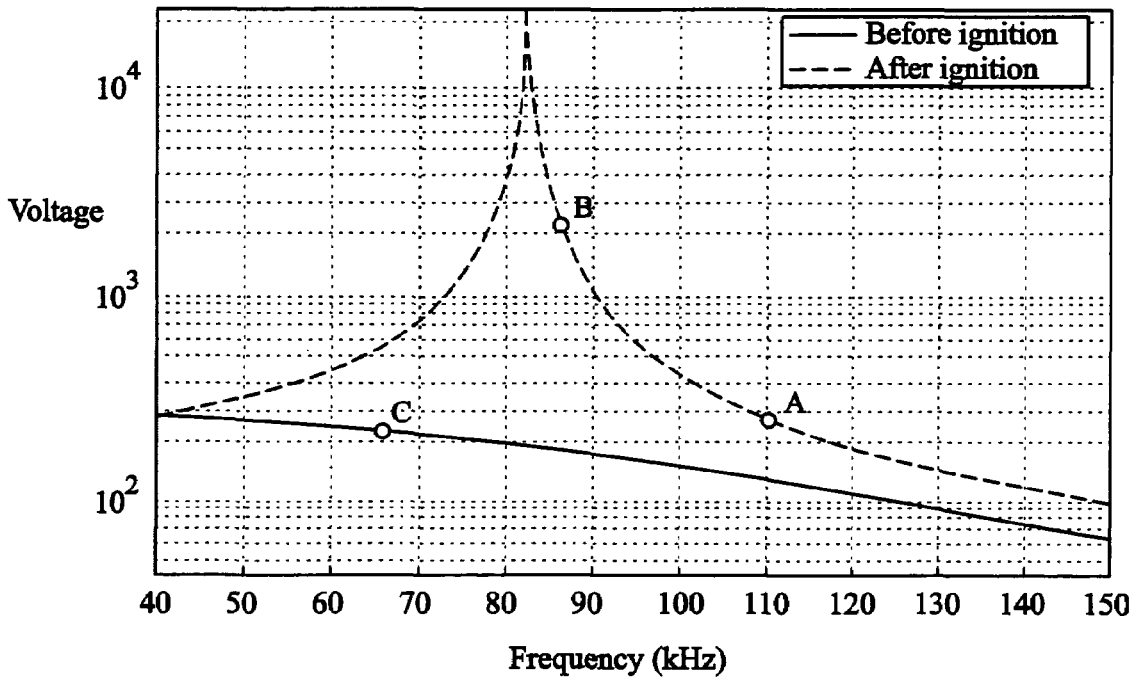
FIG. 2 is a graphical representation (bode plot) of the output voltage as a function of inverter frequency for the inverter of FIG. 1, both before and after lamp ignition.
Figure 3:
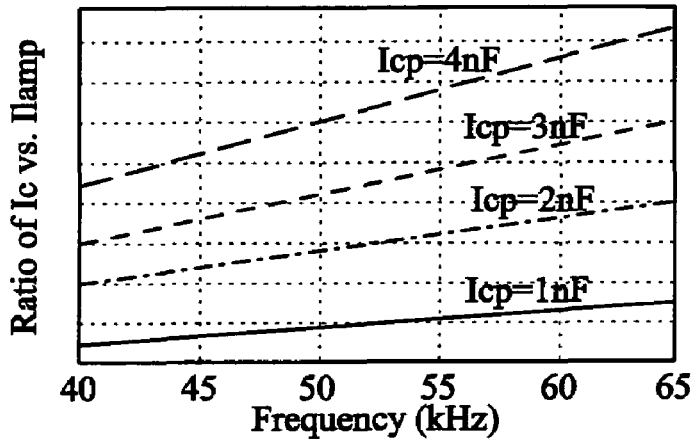
FIG. 3 is a graphical representation of the inverter circulation current as a function of inverter frequency for different value of resonant tank capacitor Cp
Figure 4:
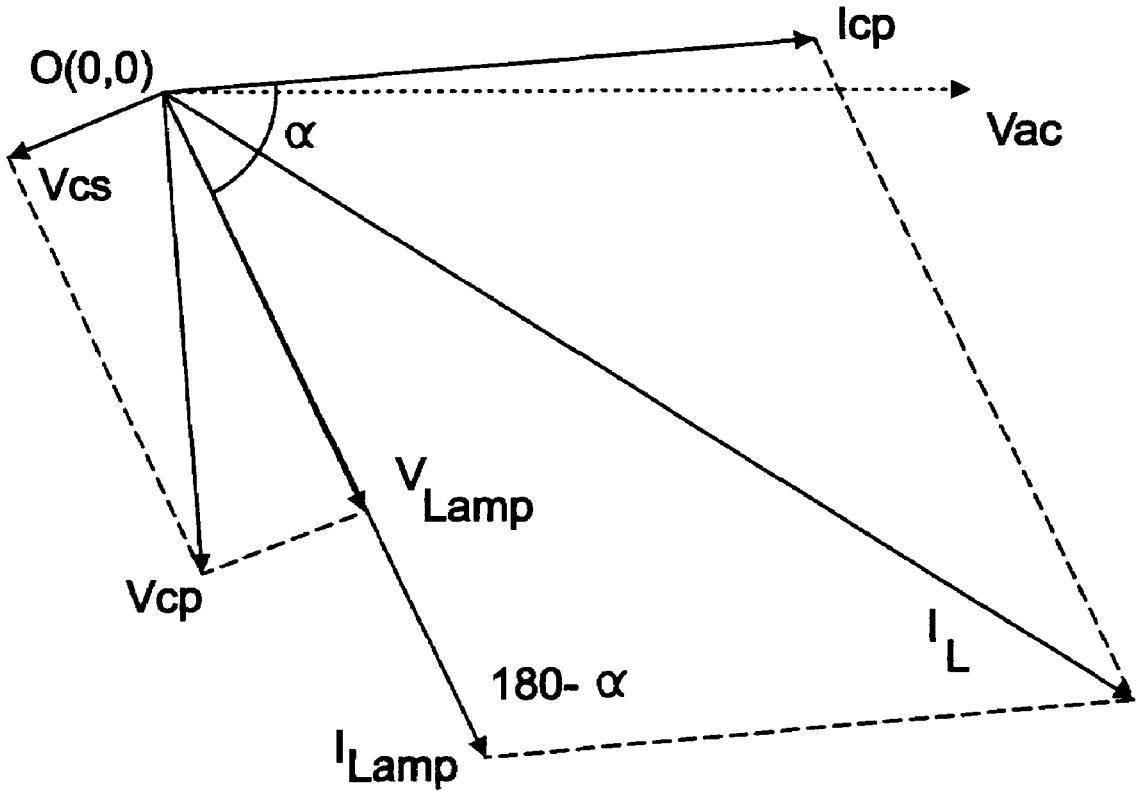
FIG. 4 is a vector representation of lamp and inverter currents and voltages for the inverter of FIG. 1.
Figure 5:
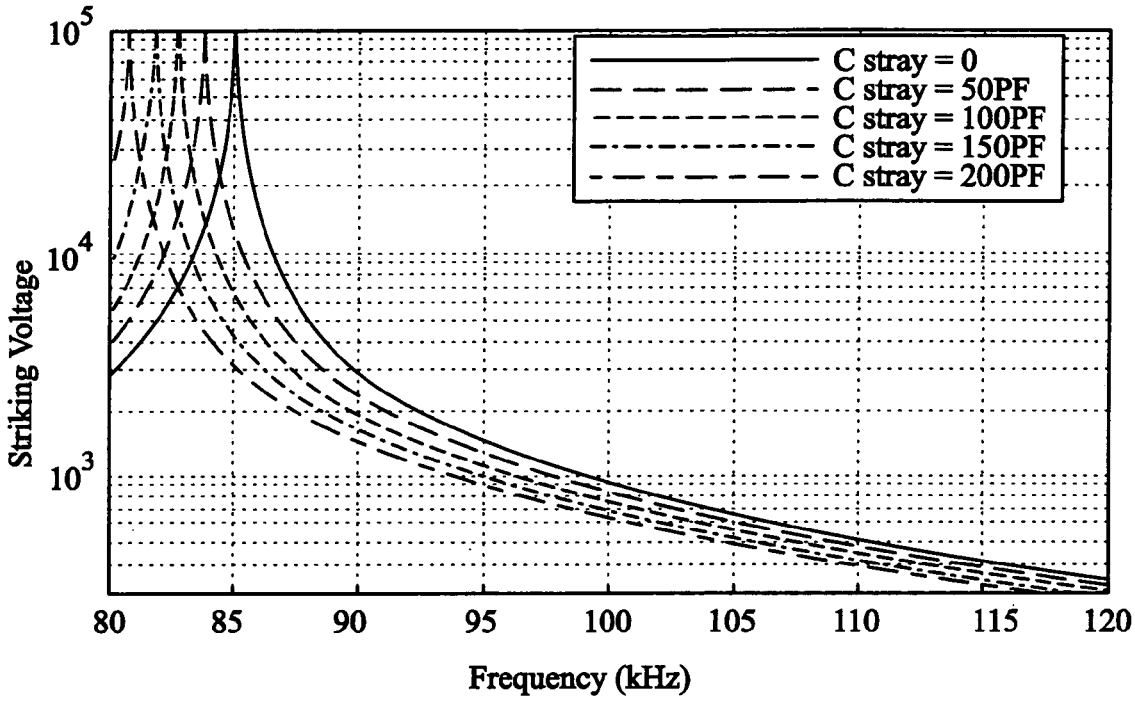
FIG. 5 is a graphical representation of the frequency response of the resonant tank of the inverter of FIG. 1, for different values of stray capacitance (Cstray).
Figure 8:
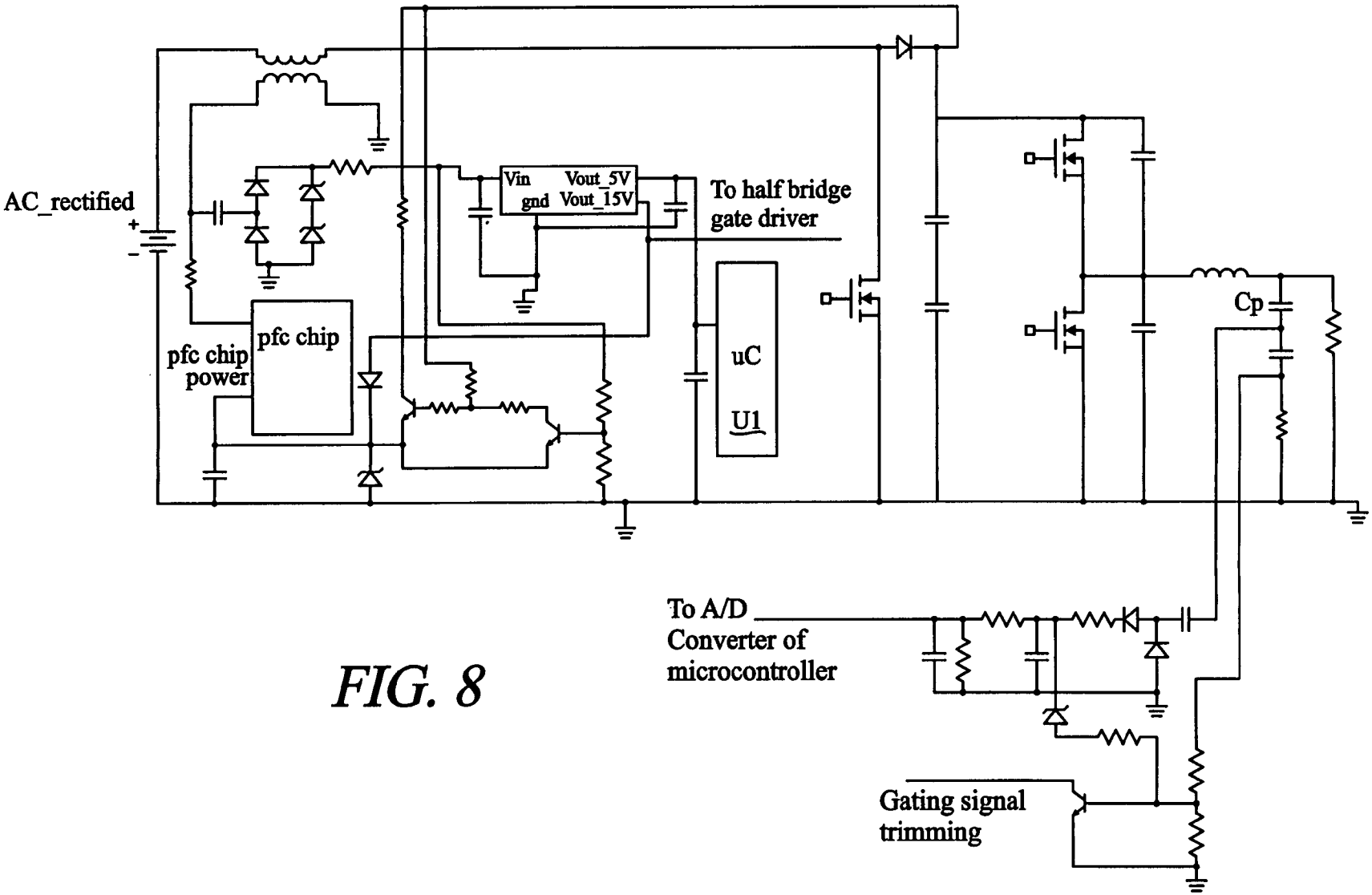
FIG. 8 is a schematic diagram of a microcontroller-based electronic ballast in accordance with the present invention.

In coventional microcontroller-based electronic ballasts, the microcontroller generates the frequency signal for the ballast. For example, in the ballast of FIG. 1, the frequency of the FET (S1 and S2) gate signals is controlled by the microcontroller (not shown). In the present invention as shown in FIG. 8, the microcontroller U1 also samples the lamp voltage, which is proportional to the voltage across the resonant capacitor Cp. This sampling is done using a simple analog filter circuit comprising resistors and capacitors. The output of the filter circuit is coupled to an analog input pin on microcontroller U1. An A/D converted integral to microcontroller U1 converts the analog signal to a digital signal representative of the voltage across the resonant capacitor Cp. This digital signal is compared to one or more reference signal stored in the microcontroller U1. Thus, the microcontroller U1 is used as an analog network analyer to detect the frequency response of the resonant tank by driving the resonant tank with the inverter at different frequencies and detecting the voltage across the resonant capacitor.

To determine variation in the resonant tank parameters, measurement of the frequency response at one or more frequency points is sufficient. These measurement frequencies can be at the nominal preheat frequency or higher. The measurement takes less than 10 ms using a conventional, low-cost microcontroller and a simple analog filter comprising a network of resistors and capacitors. The sampling is performed at the start of the preheat phase for program start ballasts. Microprocessor controlled instant start ballasts usually start ignition with a brief duration tentative voltage pulse. After a short time the microprocessor checks if current has come through the lamps. If it has, ignition proceeds. If it has not, the attempt is aborted because there must be some fault condition. For instant start ballasts, the sampling can be performed before pinging of the lamp.

Figure 9:
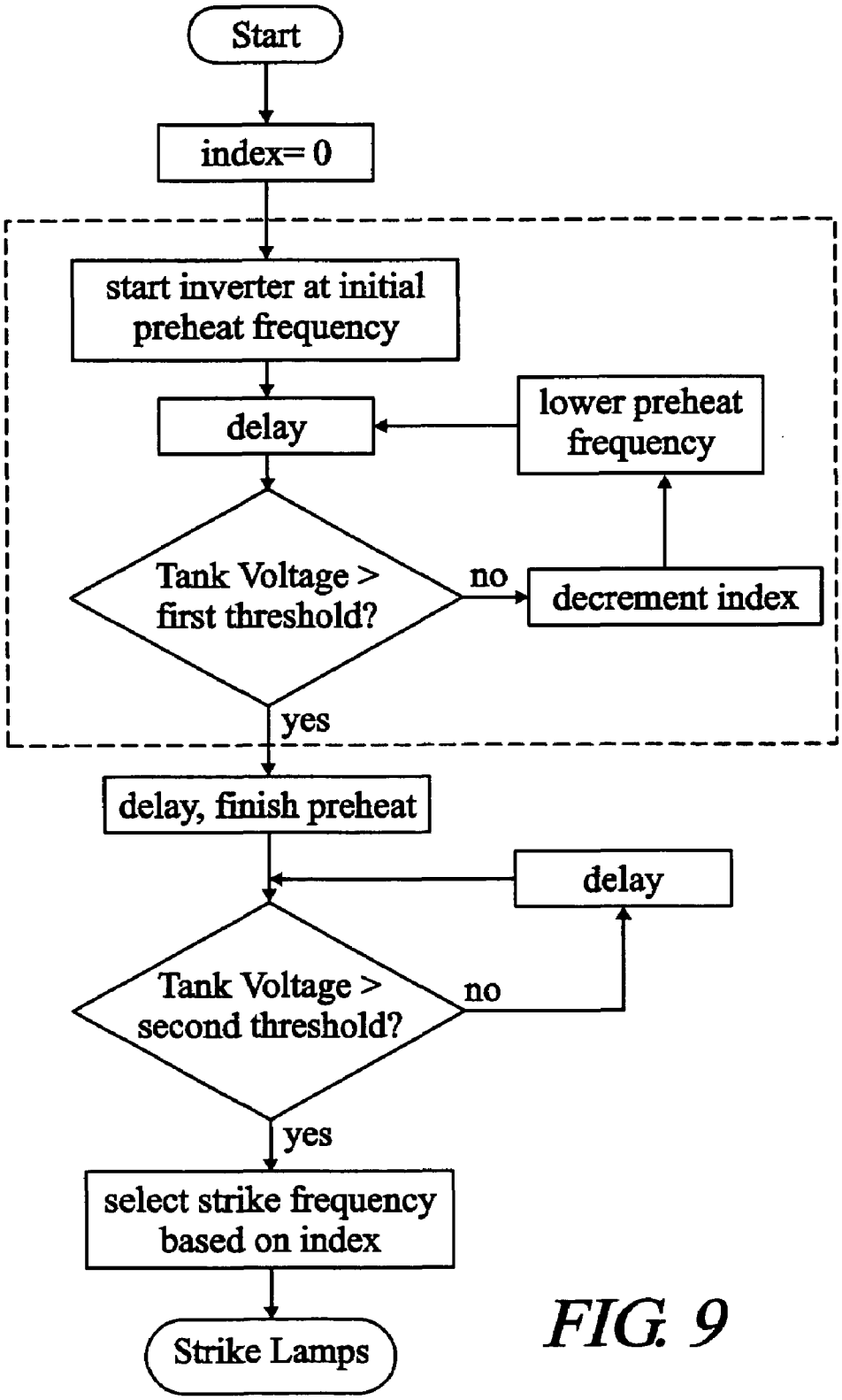
FIG. 9 is a flow chart illustrating the sequence of steps performed by the microcontroller hardware and software during a programmed start in accordance with one embodiment of the present invention.

In one embodiment of the invention as shown in FIG. 9, two adaptive stages are implemented with the microcontroller, using multiple point frequency response measurements. The inverter control circuit, preferably a low-cost microcontroller, includes a frequency response program that measures the frequency response of the resonant output circuit and frequency control program that controls the frequency of the inverter. The first adaptive stage (ping tank stage) commences early in the preheat phase when, in accordance with instructions in the frequency response program, a frequency index is set to 0. The ballast inverter is then started at an initial preheat frequency. After a programmed delay, the voltage across the resonant capacitor is detected and compared with a reference value stored in the microcontroller memory. When the measured voltage is below the reference value, the inverter preheat frequency is decreased according to a preset frequency step adjustment table-. The measurement is repeated and the comparison continues until the measured voltage is not lower than the reference value or until the number of comparison steps exceeds a preset maximum value.

The preheat frequency is adjusted at this stage to insure that the preheat voltage across the lamp filament is essentially constant regardless of the length of external cable connected between the ballast and the lamp fixture. A look-up table or software algorithm can be used to determine the preheat frequency.

As shown on FIG. 9, the second adaptive stage begins at the end of the preheat phase, before the striking of the lamp. The voltage across the load is detected again and compared with a second threshold or reference value. This step is performed to adjust the ignition frequency and strike with better accuracy after the filament is heated, because the Q value of the tank circuit can change due to the heated filaments.

Figure 6:
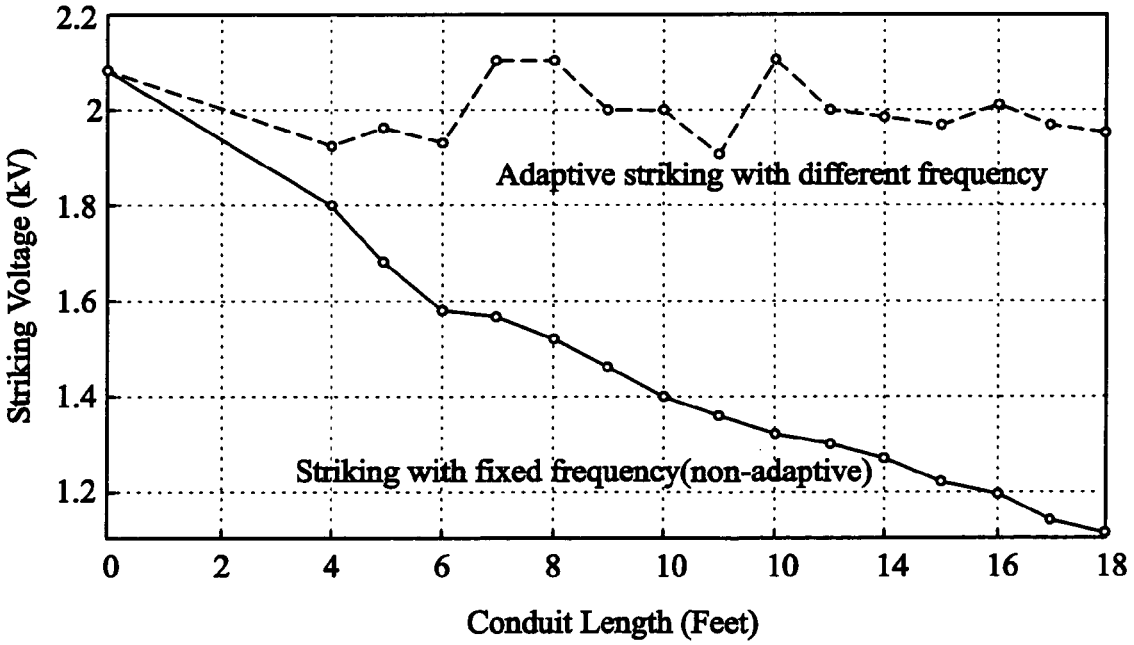
FIG. 6 is a graphical representation of lamp striking voltage as a function of the length of external conduit connected between the ballast output and the lamp fixture.
Figure 7:
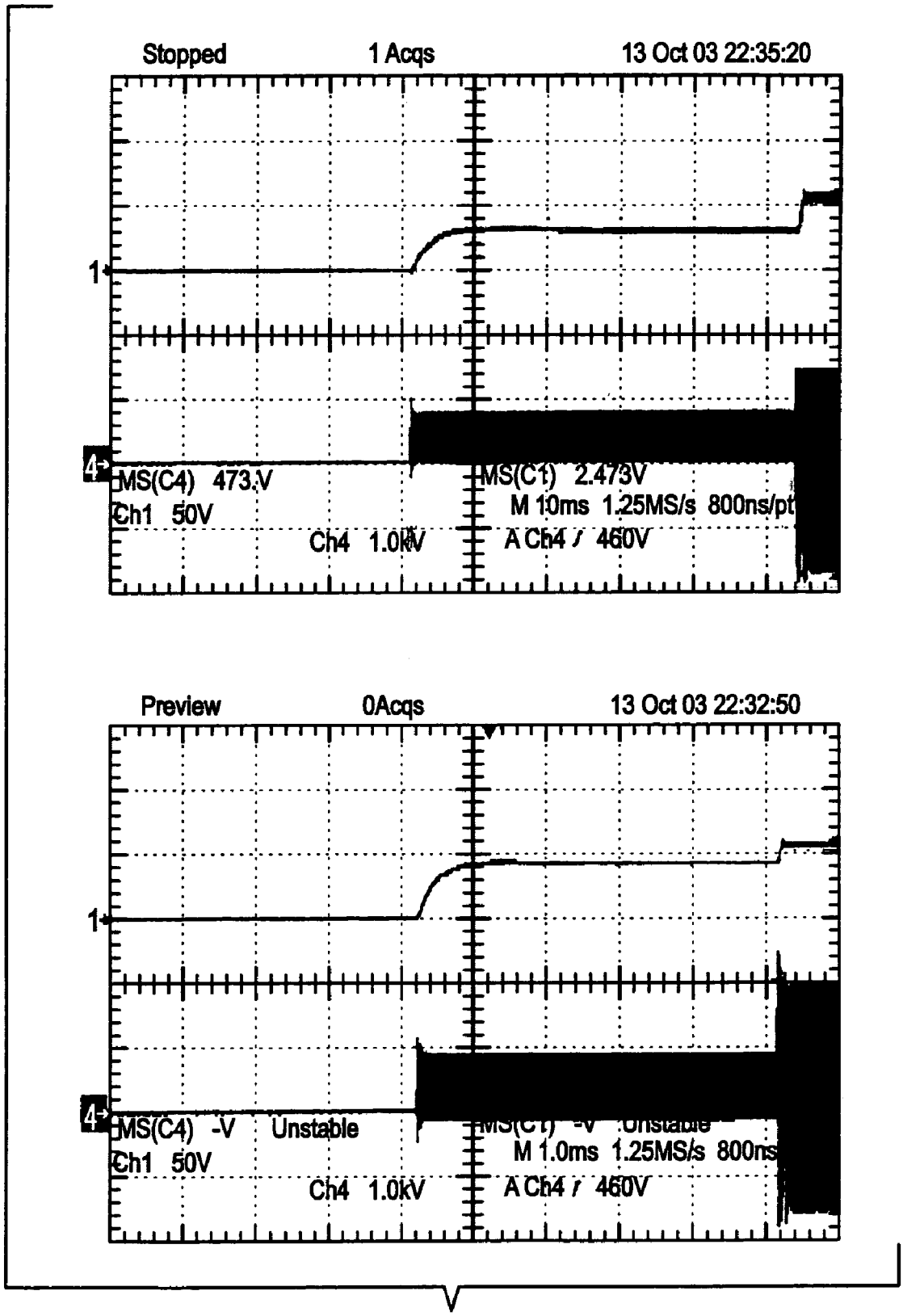
FIG. 7 is an oscillograph showing the voltage across the resonant capacitor, $V_{Cp}$, (CH 1) and the signal at the A/D conversion pin of the microcontroller (CH 4) as a function of time during the adaptation steps performed at the beginning of the preheat phase.

In one embodiment of the invention, a programmed start electronic ballast is controlled by a microcontroller. The striking voltage is preset to 2 kV. A multiple frequency point comparison and match is used to search the optimum frequency for both preheating and striking of the lamp. At the start of preheat phase and by decrease from a higher frequency, this algorithm compares the voltage across Cp with stored preset values until the measured and stored values match. This insures that the lamp filament is always preheated with nearly constant energy to maximized lamp life. At the end of the preheat phase, the tank frequency response is checked again to adapt to the potential change of the Q value due to the change of resistance of the filaments. At this point, the optimum lamp striking frequency is loaded by the software to strike the lamp. With different lengths of conduit and the same parameters of the resonant tank, the striking voltages were recorded and compared as shown in FIG. 6. The results demonstrate that the striking voltage is essentially independent of external conduit length. With 21 feet of conduit between the ballast and the lamps, the waveforms of the early phase of preheat are shown in FIG. 7 with channel 1 measuring Vcp and channel 4 measuring the signal of the A/D conversion pin for Vcp. After an initial delay to avoid start transients, the inverter frequency changed seven steps downward to search the optimum frequency for filament preheat. With each step, there is an overshoot on the trace of channel 4 representing the transient of frequency shift. At the end of this sequence, the frequency response of the tank was determined and both the preheat and striking frequency were determined and loaded. Testing indicates that the ballast can strike the lamps with a conduit as long as 30 feet, using a small Cp.

The present invention compensates for the influence of stray capacitance and for any change in Q value of the resonant tank caused by temperature rise of the filaments or the glow of the lamp. In this way, the resonant capacitor can be selected to be a minimum value. The stray capacitance alters the frequency response of the tank, but the ballast can adapt to the change and adjust the frequency accordingly. The loss, heat, and cost of the ballast can then be reduced with the performance enhanced. The flexibility to use a smaller Cp makes it possible to choose the ratio of the preheat frequency to normal running frequency to be higher than in a conventional design. The ratios of the impedance at preheat frequency and normal running frequency of the filament capacitors, C3, C4 and C5 in FIG. 1, can be higher. Accordingly, the filament losses at normal running state can be reduced.

Thus, although there have been described particular embodiments of the present invention of a new and useful. Electronic Ballast with Adaptive Lamp Preheat and Ignition, it is not intended that such references be construed as limitations upon the scope of this invention except as set forth in the following claims.

What is claimed is:

1. An electronic ballast for operating a gas discharge lamp, the ballast comprising:

an inverter circuit, the inverter circuit operable at one or more inverter frequencies;

a resonant output circuit electrically coupled to the inverter circuit;

an inverter control circuit operatively connected to the inverter circuit, the control circuit operative to vary the inverter frequency;

the inverter control circuit further operative to measure a frequency response of the resonant output circuit; and wherein the inverter control circuit is responsive to the measured frequency response of the resonant output circuit to select a lamp preheat frequency and lamp strike frequency for the inverter.

2. The electronic ballast of claim 1, wherein the inverter frequency during a lamp preheat phase is adjusted in response to the measurement of the frequency response of the resonant output circuit.

3. The electronic ballast of claim 2, wherein the inverter frequency during a lamp ignition phase is chosen in response to the measurement of the frequency response of the resonant output circuit.

4. The electronic ballast of claim 3, wherein the inverter control circuit further comprises a frequency response program that measures the frequency response of the resonant output circuit before and after a preheating of a filament.

5. The electronic ballast of claim 1 wherein the inverter control circuit comprises a microcontroller.

6. A method of controlling an electronic ballast connected to a gas discharge lamp, the electronic ballast including an inverter having an adjustable inverter frequency, a control circuit operable to adjust the inverter frequency, and a resonant output circuit electrically connected between the inverter and the lamp, the method comprising the steps of:

a. using the inverter and the control circuit to measure a frequency response of the resonant output circuit; and b. using the measured frequency response of the resonant output circuit to cause the control circuit to adjust the inverter frequency.

7. The method of claim 6 further comprising the steps of:

a. using the measured frequency response of the resonant output circuit to cause the control circuit to adjust the inverter frequency during a lamp preheat phase; and b. using the measured frequency response of the resonant output circuit to cause the control circuit to adjust the inverter frequency during a lamp ignition phase.

8. The method of claim 7 wherein the step of measuring the frequency response of the resonant output circuit comprises driving the resonant output circuit with the inverter at different inverter frequencies and detecting a voltage across a component in the resonant output circuit at each of the different inverter frequencies.

9. A method of starting a gas discharge lamp using an electronic ballast having an inverter operating at one or more inverter frequencies and a resonant output circuit, the method comprising the steps of:

a. initiate a lamp preheat phase by starting the inverter at a first lamp preheat frequency;

b. measuring the frequency response of the resonant output circuit by comparing a tank voltage in the resonant output circuit to a first voltage threshold;

c. lowering the lamp preheat frequency until the tank voltage exceeds the first voltage threshold;

d. completing the lamp preheat phase;

e. comparing the tank voltage to a second voltage threshold;

f. adjusting the inverter frequency until the tank voltage is greater than the second voltage threshold, and g. striking the lamp.

* * * * *